US011150004B1

(12) United States Patent
Kumar et al.

(10) Patent No.: US 11,150,004 B1
(45) Date of Patent: Oct. 19, 2021

(54) INTEGRATED ICE CHUTE WITH DISPENSER HOUSING

(71) Applicant: Electrolux Home Products, Inc., Charlotte, NC (US)

(72) Inventors: Sandeep Kumar, Anderson, SC (US); Cory Dale Simpson, Abbeville, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/983,111

(22) Filed: Aug. 3, 2020

(51) Int. Cl.
*F25D 3/00* (2006.01)
*F25C 5/20* (2018.01)
*F25D 23/02* (2006.01)

(52) U.S. Cl.
CPC ..... *F25C 5/22* (2018.01); *F25D 23/028* (2013.01); *F25C 2400/04* (2013.01)

(58) Field of Classification Search
CPC ..... F25C 5/22; F25C 2400/10; F25C 5/20; F25D 23/028; F25D 2323/122; F25D 23/02; F25D 31/002; B67D 1/0889; F21W 2131/305
See application file for complete search history.

(56) References Cited

U.S. PATENT DOCUMENTS 5,272,888 A * 12/1993 Fisher ..... F25C 5/22 62/344
5,442,933 A * 8/1995 Unger ..... F25C 5/22 62/275
5,474,213 A * 12/1995 Unger ..... F25C 5/22 222/108
5,526,854 A * 6/1996 Unger ..... F25C 5/22 141/351
6,267,272 B1 * 7/2001 Shin ..... F25C 5/22 222/505
7,219,509 B2 5/2007 Pastryk et al.
7,340,914 B2 3/2008 Bowen et al.
7,418,830 B2 9/2008 Bowen et al.
7,418,831 B2 9/2008 Bowen et al.
7,587,910 B2 9/2009 Bowen et al.
7,617,698 B2 11/2009 Bowen et al.
7,703,297 B2 4/2010 Bowen et al.
7,980,089 B2 * 7/2011 Bowen ..... F25C 5/20 62/344
8,844,311 B2 9/2014 Bowen et al.
9,423,167 B2 8/2016 Bowen et al.
10,107,539 B2 10/2018 Bowen et al.
(Continued)

FOREIGN PATENT DOCUMENTS

WO WO-2007054166 A1 * 5/2007 ..... F25C 5/22

*Primary Examiner* — Frantz F Jules
*Assistant Examiner* — Martha Tadesse
(74) *Attorney, Agent, or Firm* — Pearne & Gordon LLP

(57) ABSTRACT

A dispenser assembly for a refrigerator door. The dispenser assembly including a superjacent housing having an open front and an ice chute extending from a rear of the superjacent housing. The ice chute has a proximal end integrally attached to the rear of the superjacent housing and an open distal end. A subjacent housing has an upper end attachable to a lower end of the superjacent housing. The subjacent housing has an open front defining a cavity for receiving a container. The lower end of the superjacent housing is configured to sealingly engage with the upper end of the subjacent housing.

16 Claims, 18 Drawing Sheets

(56) References Cited

U.S. PATENT DOCUMENTS

| | | | | |
|---|---|---|---|---|
| 10,407,290 | B2 * | 9/2019 | Sanchez | B67D 1/0014 |
| 2006/0201194 | A1 * | 9/2006 | Bowen | F25D 31/002 62/344 |
| 2008/0156011 | A1 * | 7/2008 | Culley | F25C 5/22 62/228.1 |
| 2010/0218542 | A1 * | 9/2010 | McCollough | F25C 5/187 62/345 |
| 2011/0139817 | A1 * | 6/2011 | Lu | F25D 27/00 62/264 |
| 2011/0174008 | A1 * | 7/2011 | Kim | H05B 31/50 62/264 |
| 2011/0239689 | A1 * | 10/2011 | Bai | F25D 23/02 62/389 |
| 2011/0283733 | A1 * | 11/2011 | Bai | F25D 21/04 62/389 |
| 2018/0149410 | A1 * | 5/2018 | Shrader | F25D 25/025 |
| 2019/0032983 | A1 | 1/2019 | Bowen et al. | |

* cited by examiner

INTEGRATED ICE CHUTE WITH DISPENSER HOUSING

FIELD OF THE INVENTION

This application relates generally to a refrigeration appliance, and more particularly, to a refrigeration appliance that includes a dispenser assembly in a door of the refrigeration appliance for delivering water and/or ice to a user.

BACKGROUND OF THE INVENTION

Refrigeration appliances, such as household refrigerators for example, often are provided with ice and water dispensing systems and units that include dispensing stations at which ice and water can be accessed by users. The dispensing stations can be located at the exteriors of doors that serve to close off the interiors of the refrigeration appliance compartments. In the case of a side-by-side household refrigerator for example, the ice and water dispensing station typically is located at the exterior of the freezer compartment door. On the other hand, in the case of a bottom-mount household refrigerator, that is, a refrigerator in which the freezer compartment is located beneath the fresh food compartment, the ice and water dispensing station typically is located at the exterior of a single door at the fresh food compartment or one of the doors a French-style door arrangement.

Conventional dispensing stations including a housing that is attached to the door. The housing includes a variety of parts that must be mated to each other during assembly. Due to the variability in the parts it is often the case during manufacturing that expanding insulation foam leaks between the mating parts and into the dispensing station when the door of the refrigerator is foamed.

The present invention provides an ice dispenser assembly with fewer parts and fewer failure points, as compared to ice dispenser assemblies known heretofore.

BRIEF SUMMARY OF THE INVENTION

There is provided a dispenser assembly for a refrigerator door. The dispenser assembly including a superjacent housing having an open front and an ice chute extending from a rear of the superjacent housing. The ice chute has a proximal end integrally attached to the rear of the superjacent housing and an open distal end. A subjacent housing has an upper end attachable to a lower end of the superjacent housing. The subjacent housing has an open front defining a cavity for receiving a container. The lower end of the superjacent housing is configured to sealingly engage with the upper end of the subjacent housing.

In the foregoing dispenser assembly, the superjacent housing may include an opening in the lower end that communicates with an opening in the upper end of the subjacent housing when the superjacent housing engages the subjacent housing.

In the foregoing dispenser assembly, the lower end of the superjacent housing and the upper end the subjacent housing configured to define a tortuous path therebetween when the superjacent housing is attached to the subjacent housing to thereby provide said sealing engagement.

In the foregoing dispenser assembly, the tortuous path being defined by one of the lower end of the superjacent housing and the upper end of the subjacent housing including spaced-apart flanges configured to sealingly engage a mating flange in the other of the lower end of the superjacent housing and the upper end of the subjacent housing.

In the foregoing dispenser assembly, the open distal end of the ice chute may be configured to sealingly engage an inner liner of a refrigerator door.

In the foregoing dispenser assembly, the ice chute may be integrally formed to the rear of the superjacent housing.

In the foregoing dispenser assembly, the superjacent housing and the subjacent housing may be secured to each other.

In the foregoing dispenser assembly, one of the lower end of the superjacent housing and the upper end of the subjacent housing may include a receiving element to receive a corresponding engagement element in the other of the lower end of the superjacent housing and the upper end of subjacent housing.

In the foregoing dispenser assembly, the receiving element may be a notch and the corresponding engagement element may be a tab that engages the notch in a snap-fit manner.

In the foregoing dispenser assembly, the superjacent housing and the subjacent housing may be made of a plastic material.

There is also provided a refrigerator door including an outer shell having an opening formed therein. An inner liner may be attached to a rear of the outer shell to define a sealed cavity configured to be filled with an insulating material. The inner liner may include an opening. A dispenser assembly may be disposed in the sealed cavity formed between the outer shell and the inner liner. The dispenser assembly including a superjacent housing attached to the outer shell and including an open front communicating with the opening of the outer shell and an ice chute extending from a rear of the superjacent housing. The ice chute has a proximal end integrally attached to the rear of the superjacent housing and an open distal end sealingly attached to the inner liner and communicating with the opening of the inner liner. A subjacent housing is attached to a lower end of the superjacent housing. The subjacent housing has an open front communicating with the opening of the outer shell and defining a cavity for receiving a container. The lower end of the superjacent housing is configured to sealingly engage the upper end of the subjacent housing and the superjacent housing and the subjacent housing sealingly engages the outer shell around the opening of the outer shell.

In the foregoing refrigerator door, the superjacent housing may include an opening in the lower end that communicates with an opening in the upper end of the subjacent housing when the superjacent housing engages the subjacent housing.

In the foregoing refrigerator door, a tortuous path may be defined between the lower end of the superjacent housing and the upper end the subjacent housing to thereby provide said sealing engagement.

In the foregoing refrigerator door, the tortuous path may be defined by one of the lower end of the superjacent housing and the upper end of the subjacent housing including spaced-apart flanges configured to sealingly engage a mating flange in the other of the lower end of the superjacent housing and the upper end of the subjacent housing.

In the foregoing refrigerator door, a sealed passageway may be defined from the opening of the inner liner, through the ice chute, through the superjacent housing, through the subjacent housing and to the opening of the outer shell.

In the foregoing refrigerator door, the ice chute may be integrally formed to the rear of the superjacent housing.

In the foregoing refrigerator door, the superjacent housing and subjacent housing may be secured to each other.

In the foregoing refrigerator door, one of the lower end of the superjacent housing and the upper end of the subjacent housing may include a receiving element to receive a corresponding engagement element in the other of the lower end of the superjacent housing and the upper end of subjacent housing.

In the foregoing refrigerator door, the receiving element may be a notch and the corresponding engagement element may be a tab that engages the notch in a snap-fit manner.

In the foregoing refrigerator door, the superjacent housing and the subjacent housing may be made of a plastic material.

DESCRIPTION OF EXAMPLE EMBODIMENTS

Figure 1:
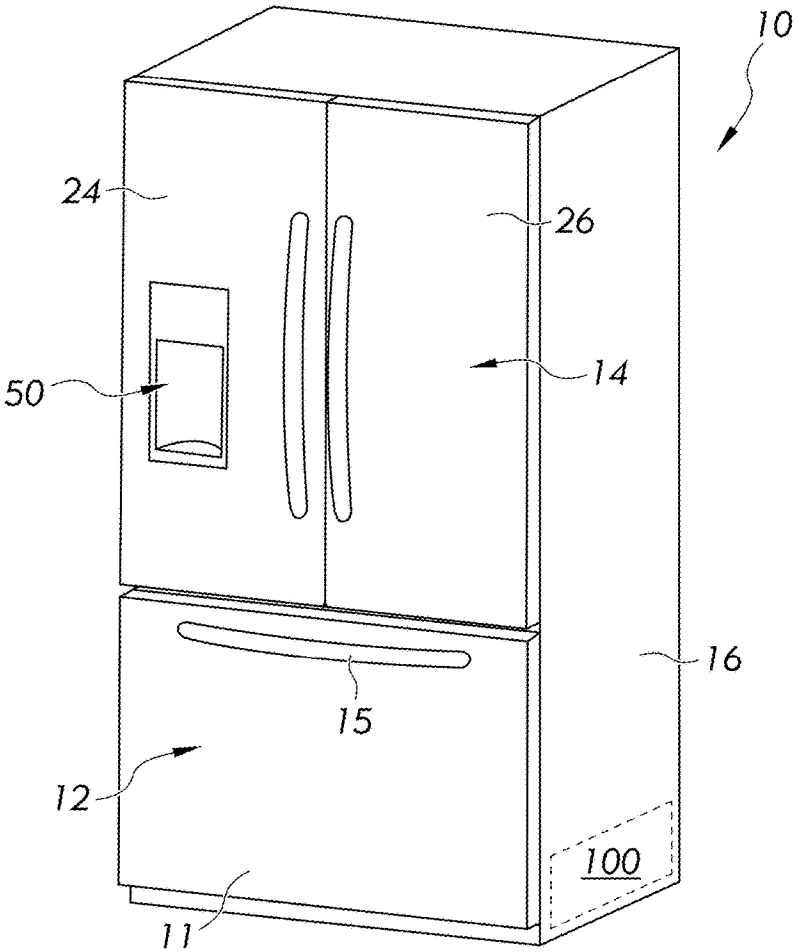
FIG. 1 is a front view of one example household refrigeration appliance showing a bottom-mount freezer compartment below a fresh food compartment, wherein a dispensing station is disposed in one French-style door.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and an ice maker 18 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 24, 26 shown in FIG. 1 are pivotally coupled to a cabinet 16 of the refrigerator 10 to restrict and grant access to the fresh food compartment 14. The refrigerator 10 can include a single door that spans the entire lateral distance across the entrance to the fresh food compartment 14, or can include a pair of French-style doors 24, 26 as shown in FIG. 1 that collectively span the entire lateral distance of the entrance to the fresh food compartment 14 to enclose the fresh food compartment 14. For the latter configuration, a center flip mullion 13 (FIG. 2) is pivotally coupled to at least one of the doors 26 to establish a surface against which a seal provided to the other one of the doors 24 can seal the entrance to the fresh food compartment 14 at a location between opposing side surfaces (FIG. 2) of the doors 24, 26. The center mullion 13 can be pivotally coupled to the door 26 to pivot between a first orientation that is substantially parallel to a planar surface of the door 26 when the door 26 is closed, and a different orientation when the door 26 is opened. The externally-exposed surface of the center mullion 13 is substantially parallel to the door 26 when the center mullion 13 is in the first orientation, and forms an angle other than parallel relative to the door 26 when the center mullion 13 is in the second orientation. The seal and the externally-exposed surface of the center mullion 13 cooperate approximately midway between the lateral sides of the fresh food compartment 14.

A dispensing assembly 50 (FIG. 1) for dispensing at least ice pieces, and optionally water, can be provided on an exterior of one of the doors 24 that restricts access to the fresh food compartment 14. The dispensing assembly 50 includes at least one lever, switch, proximity sensor or other device that a user can interact with to cause frozen ice pieces to be dispensed from the ice maker 18 disposed within the fresh food compartment 14. Ice pieces from the ice maker 18 can exit the ice maker 18 through the outlet 18*a* and be delivered to the dispensing assembly 50. The dispensing assembly 50 may also include at least one lever, switch, proximity sensor or other device that the user can interact with to cause water to be dispensed from source of water.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 19 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and eve more preferably between 0.25° C. and 4.5° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

In the embodiment shown, French-style doors 24, 26 are pivotally coupled to a cabinet 16 of the refrigerator 10 to restrict and grant access to the fresh food compartment 14 and the dispensing assembly 50 is positioned on a door front. It is contemplated that the dispensing assembly 50 may be positioned on a door side or edge or inside the cabinet 16.

Figure 2:
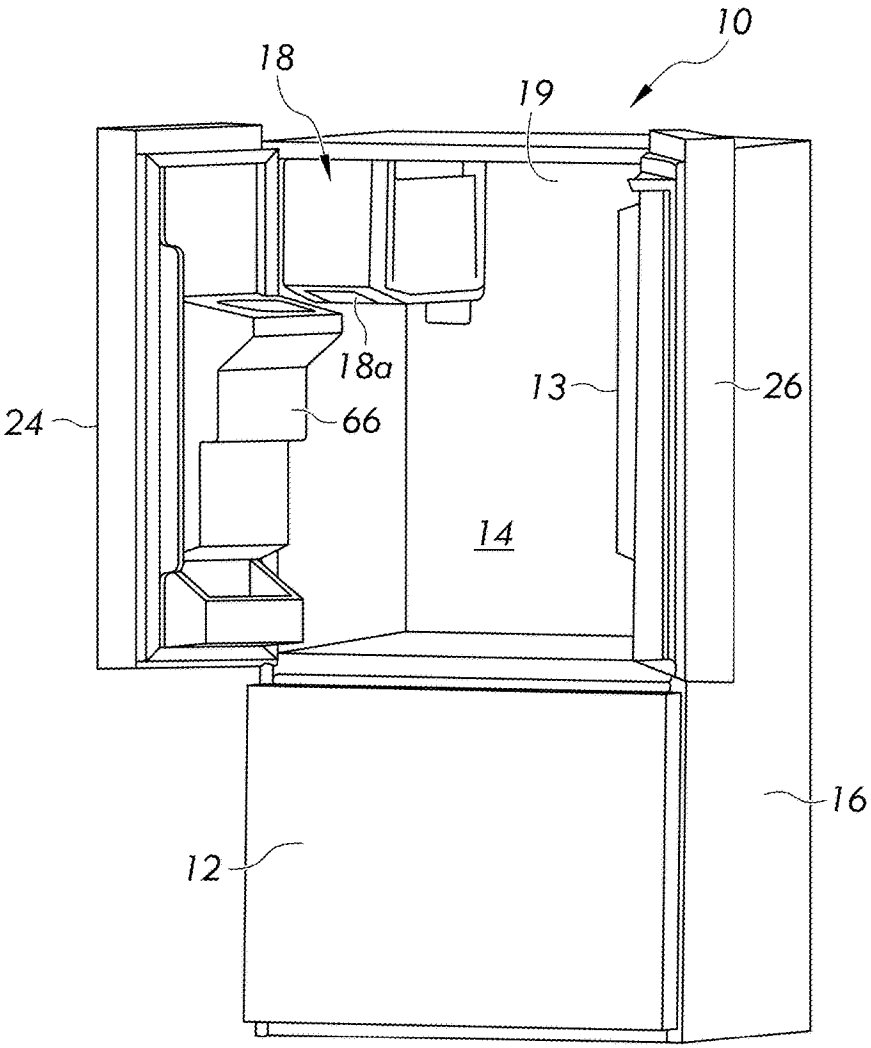
FIG. 2 is a front view of the refrigeration appliance of FIG. 1 showing the French-style doors of the fresh food compartment in an open position.

Referring to FIG. 2, when the doors 24, 26 are in an open position, access is granted to the ice maker 18 disposed in the fresh food compartment 14. The ice maker 18 includes an outlet 18*a* for supplying ice cubes to an ice chute 66 connected to a dispensing assembly (FIG. 1) in the door 24.

Figure 3:
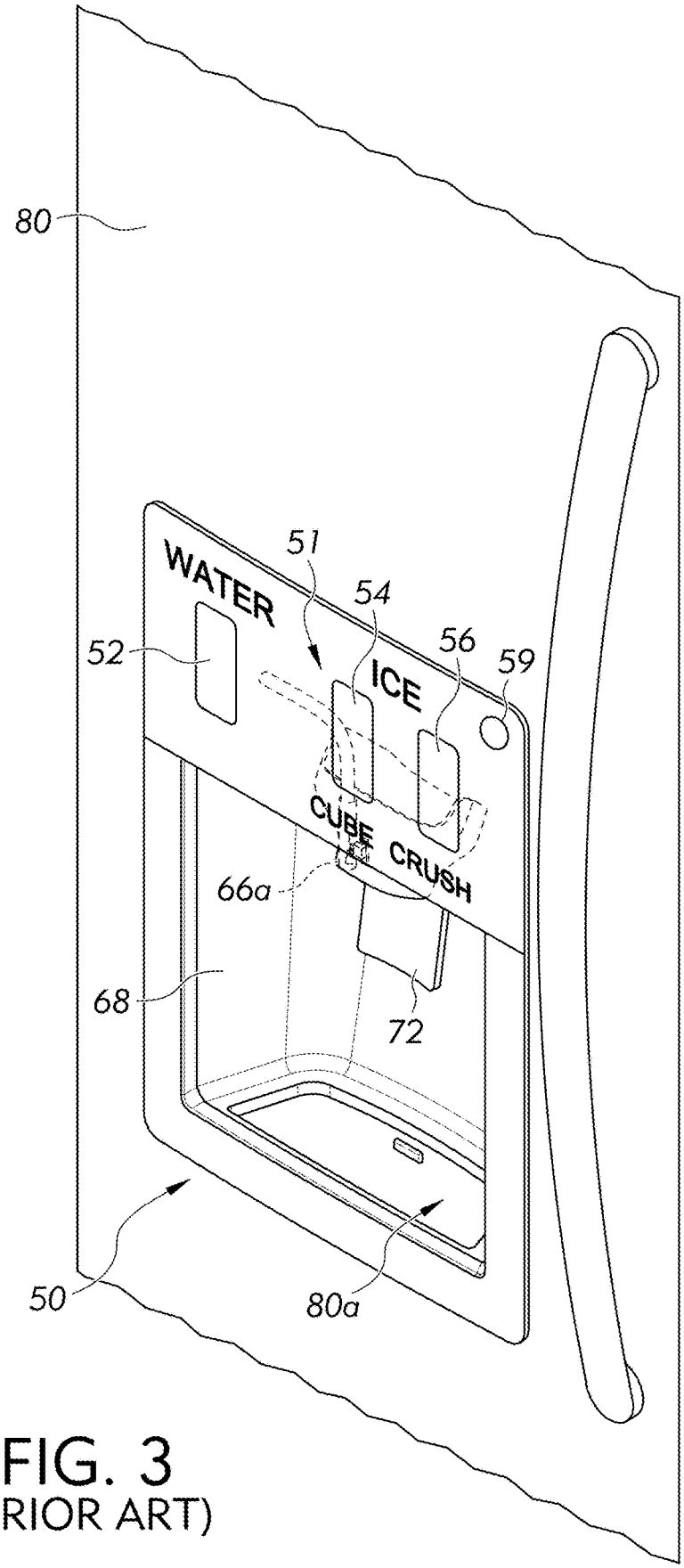
FIG. 3 (PRIOR ART)
FIG. 3 is an enlarged front perspective view of a conventional housing assembly of a dispensing station of FIG. 1.

Referring to FIG. 3, the dispensing assembly 50 includes a plurality of buttons 52, 54, 56 on a display portion 51 for allowing a user to select to dispensing water, ice cubes and crushed ice, respectively from the dispensing assembly 50. The first button 52 is a water selection button, the second button 54 is an ice cube selection button and the third button 56 is a crushed ice selection button. A sensor 59 may be positioned on the display portion 51. The sensor 59 may be configured for detecting the presence of a user at a predetermined distance from a front surface of the display portion 51. It is contemplated that the sensor 59 may be an optical sensor, a capacitive sensor, an infrared (IR) sensor, a photocell, etc.

Figure 4:
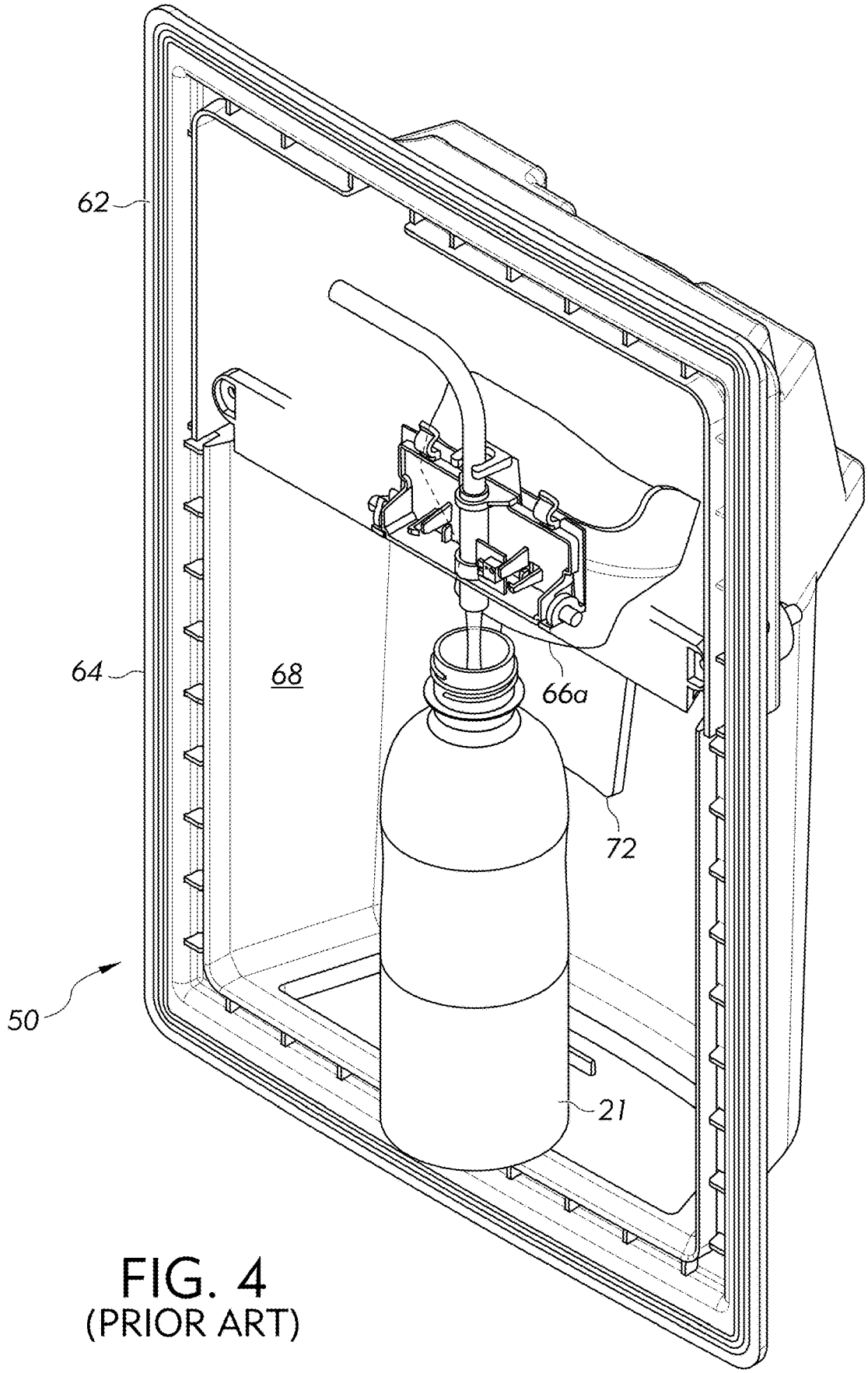
FIG. 4 (PRIOR ART)
FIG. 4 is an enlarged front perspective view of a housing of the conventional housing assembly of FIG. 3.
Figure 5:
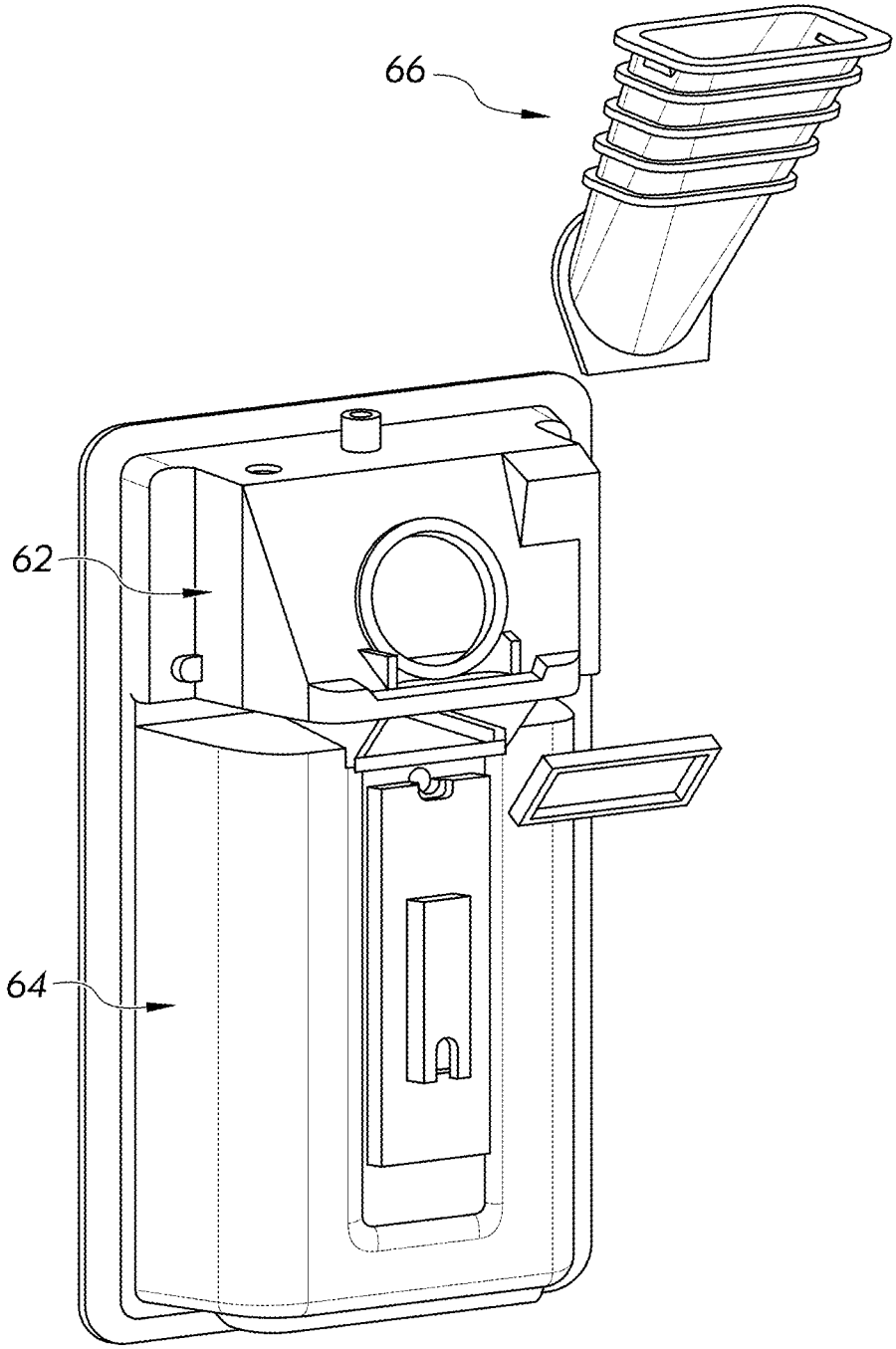
FIG. 5 (PRIOR ART)
FIG. 5 is a rear exploded view of the conventional housing assembly of FIG. 3 illustrating the housing of FIG. 4 and an ice chute.

Referring to FIGS. 4 and 5, the dispensing assembly 50 may include a conventional housing that is made up of an upper housing 62, a lower housing 64 and an ice chute 66 (FIG. 5). The upper housing 62 and the lower housing 64, which are conventionally joined and/or together as a single unitary element, define a recess or cavity 68 of the dispensing assembly 50. Conventionally the ice chute 66 is separately attached to the upper housing 62 during manufacturing. The recess or cavity 68 is configured and dimensioned to receive a container 21, e.g., a bottle (FIG. 4), a cup, a carafe, etc. An actuator or lever 72 is positioned on a rear wall of the housing. The actuator 72 is configured such that when the container 21 is pressed against the actuator 72 the product selected by the user using the buttons 52, 54, 56 is delivered to the container 21. As illustrated in FIG. 3, the dispensing assembly 50 may include an ice chute nozzle 66*a* for directing ice into the container 21 (FIG. 4).

Figure 6:
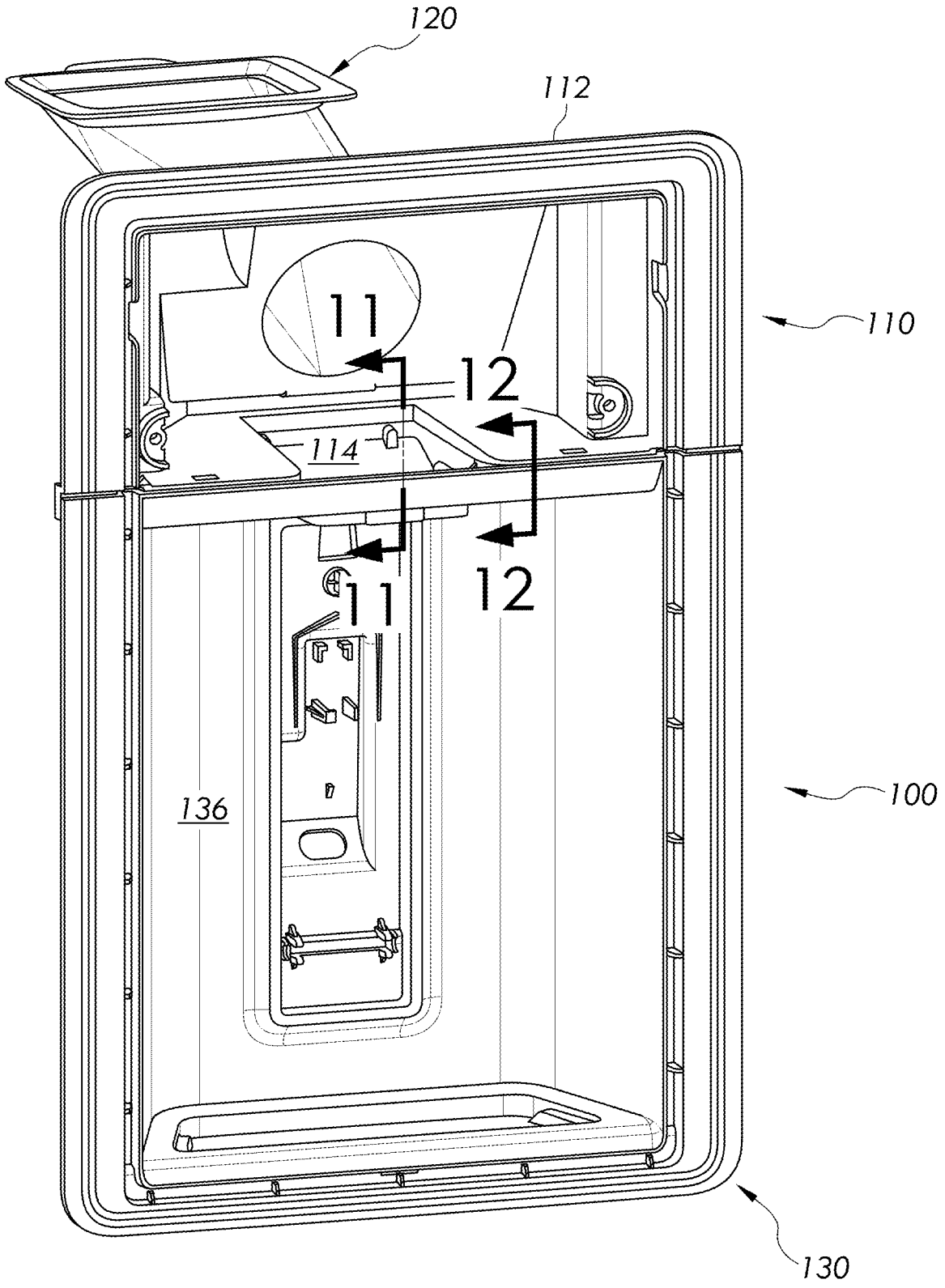
FIG. 6 is a front perspective view of a housing assembly of the dispensing station of FIG. 2, according to an embodiment of the present invention.
Figure 7:
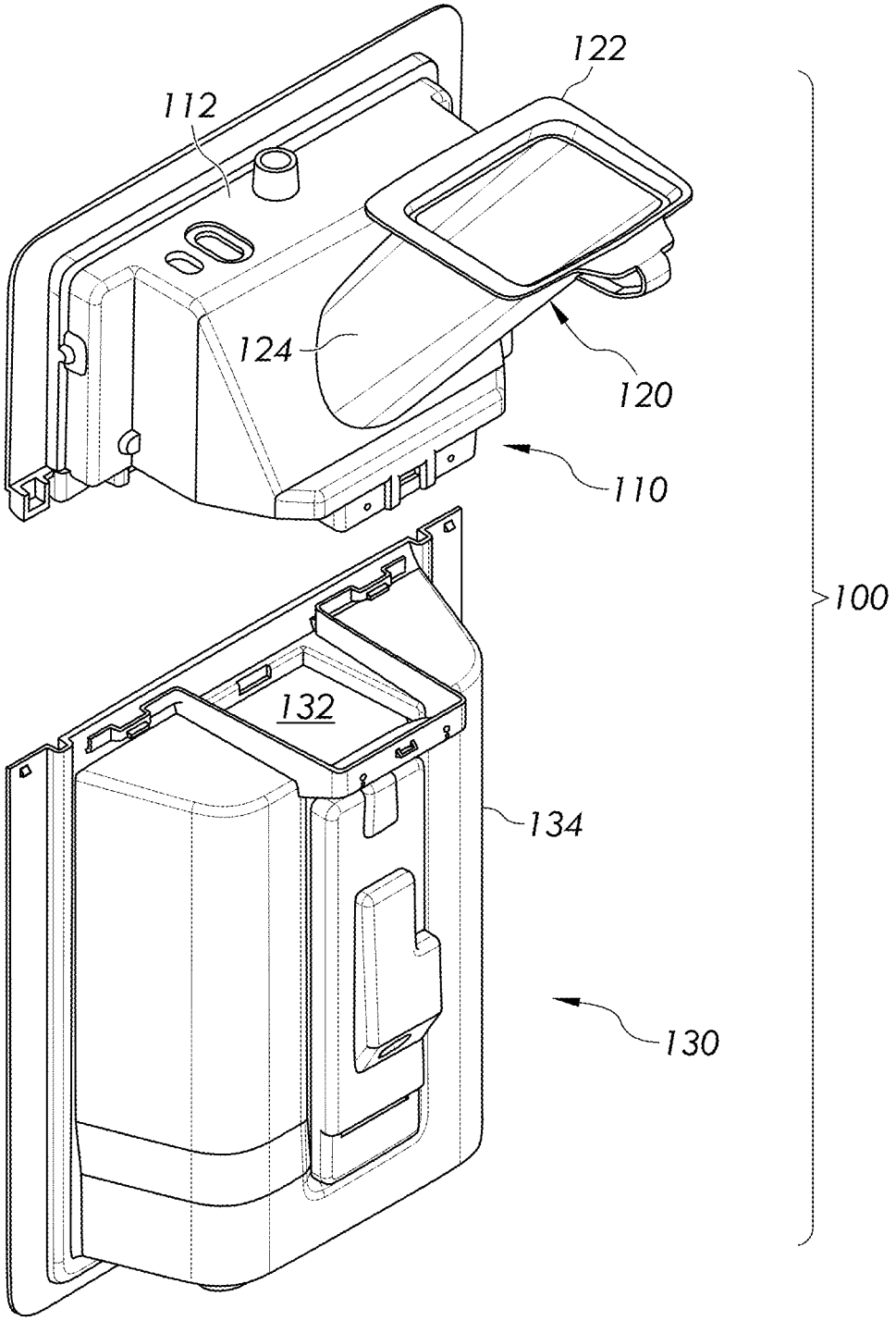
FIG. 7 is a rear exploded view of the housing assembly of FIG. 6.
Figure 8:
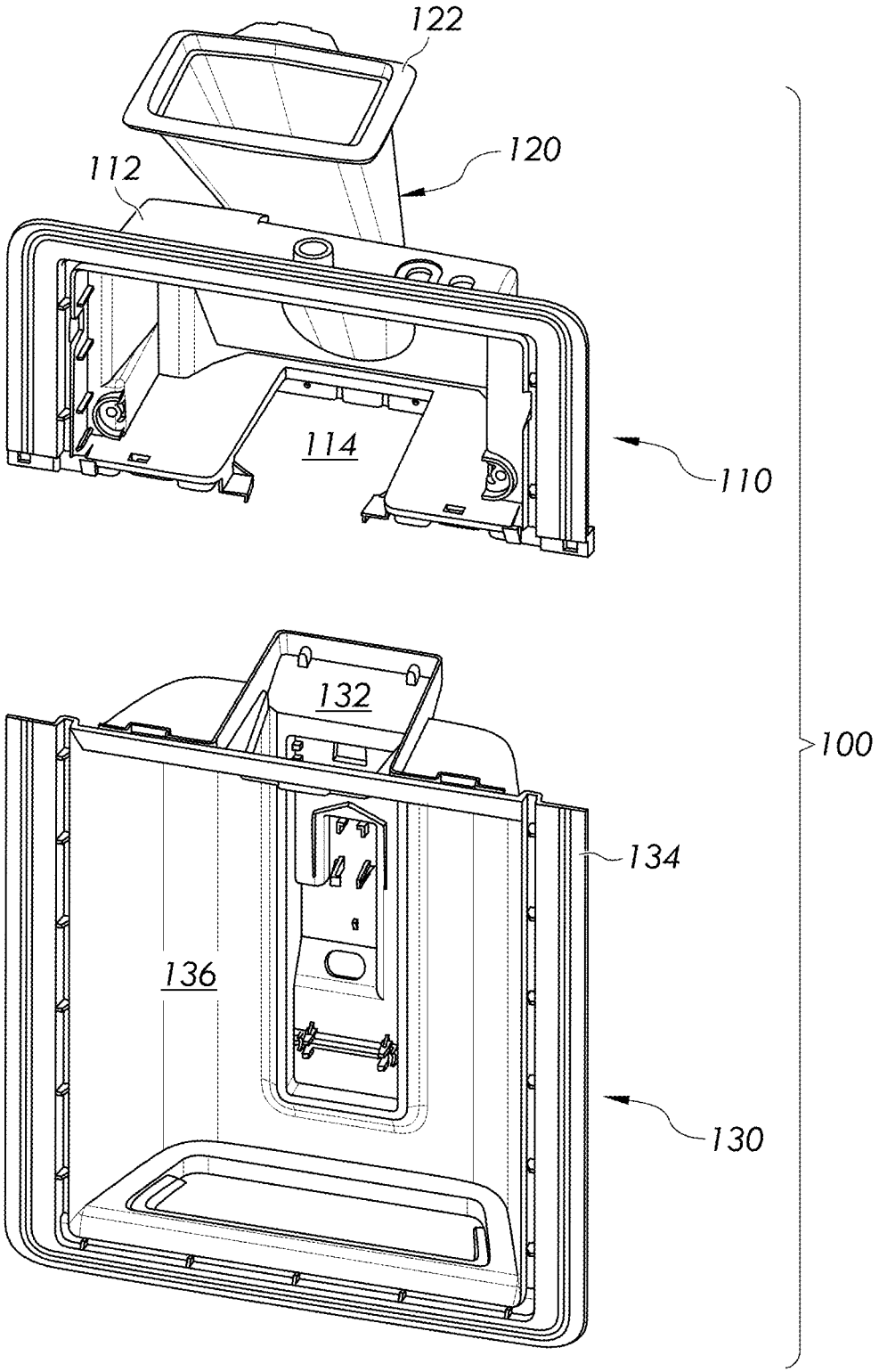
FIG. 8 is a front exploded view of the housing assembly of FIG. 6.

Referring to FIGS. 6-8, a housing 100, according to the present invention is illustrated. The housing 100 includes a superjacent housing 110 and a subjacent housing 130. That is, the superjacent housing 110 forms a relatively upper portion of the housing 100, while the subjacent housing 130 is a separate element located below the superjacent housing 110 to form a relatively lower portion of the housing 100. Both the superjacent housing 110 and the subjacent housing 130 may be made of a plastic material. As illustrated in FIG. 7, the superjacent housing 110 includes an ice chute 120 having an open distal end 122 and an opposite end 124 that is integrally formed to a body 112 of the superjacent housing 110. It is contemplated that the chute 120 may molded simultaneously with the body 112 of the superjacent housing 110.

Figure 9:
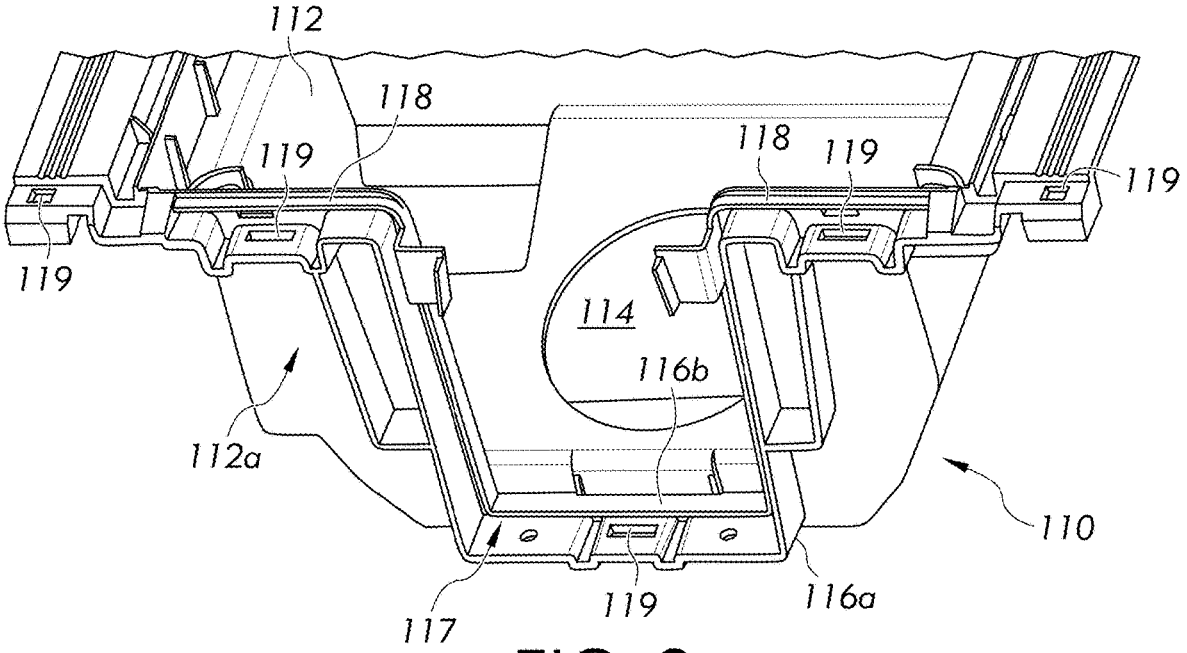
FIG. 9 is an enlarged bottom perspective view of a superjacent housing of the housing assembly of FIG. 6.

The superjacent housing 110 may include an opening 114 (FIGS. 6 and 8) in a lower end that is dimensioned and positioned to communicate with a mating opening 132 (FIGS. 7 and 8) in an upper end the subjacent housing 130, as described in detail below. Referring to FIG. 9, a pair of downward facing, spaced-apart walls or flanges 116*a*, 116*b* extend from a lower end or surface 112*a* of the superjacent housing 110 about three sides of the opening 114. The spaced-apart flanges 116*a*, 116*b* define an elongated pocket or groove 117 that is dimensioned to receive a mating feature of the subjacent housing 130, as described in detail below. Along a front edge of the body 112 (i.e., on either side of the opening 114), downward facing flanges 118*a*, 118*b* extend from the lower surface 112*a* of the body 112. The flanges 118*a*, 118*b* is dimensioned and positioned to be aligned with a mating feature of the subjacent housing 130, as described in detail below.

A plurality of receiving elements, e.g., notches or openings 119 are formed at spaced-apart locations on the lower surface 112*a*. In the embodiment illustrated, the notches 119 are elongated holes and are formed in wall portions that extend from the lower surface 112*a*. The notches 119 are positioned and dimensioned as described in detail below.

Figure 10:
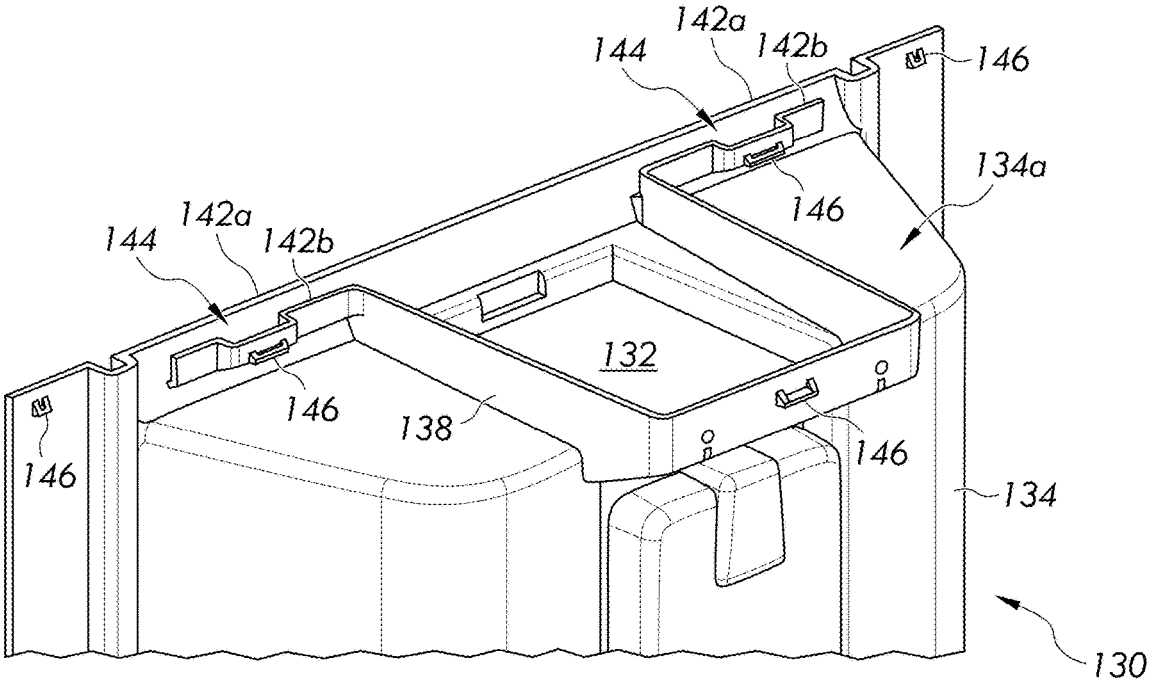
FIG. 10 is an enlarged top perspective view of a subjacent housing of the housing assembly of FIG. 6.

Referring back to FIGS. 6-8, the subjacent housing 130 may include a body 134 that defines the receiving cavity 136 of the dispensing assembly 50. In this respect, various components, including the actuator 72 (FIGS. 3 and 4) may be attached to the subjacent housing 130. Referring to FIG. 10, an upward facing wall or flange 138 extends from an upper end or surface 134*a* of the subjacent housing 130 about three sides of the opening 132. The flange 138 is dimensioned and positioned to be aligned with a mating feature of the superjacent housing 110, as described in detail below. Along a front edge of the body 134 (i.e., located or extending on either side of the opening 132) two upward-facing, spaced-apart walls or flanges 142*a*, 142*b* extend from the upper surface 134*a* of the body 134. The spaced-apart flanges 142*a*, 142*b* define an elongated pocket or groove 144 that is dimensioned to receive a mating feature of the superjacent housing 110, as described in detail below.

A plurality of engagement elements, e.g., tabs 146 are formed at spaced-apart locations on the upper surface 134*a*. In the embodiment illustrated, the tabs 146 are ramped-shaped features and are formed on wall portions that extend from the upper surface 134*a*. The tabs 146 are positioned and dimensioned as described in detail below.

Figure 11:
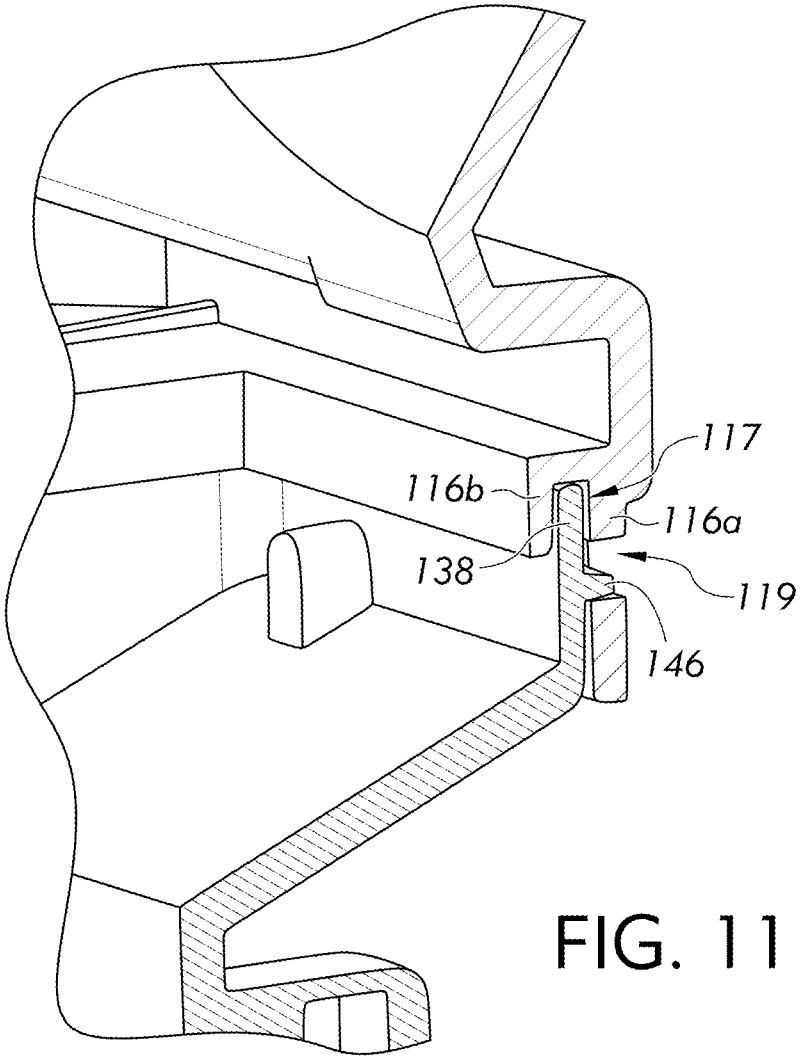
FIG. 11 is an enlarged section view taken along lines 11-11 of FIG. 6.
Figure 12:
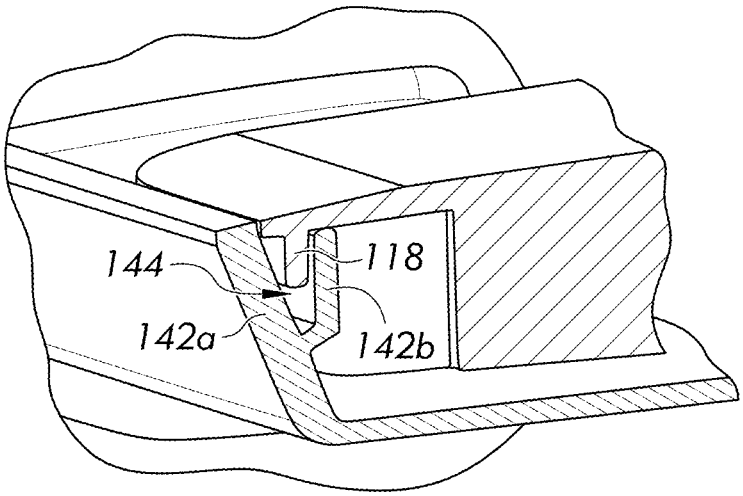
FIG. 12 is an enlarged section view taken along lines 12-12 of FIG. 6.

Referring to FIG. 11, which is a section view taken along lines 11-11 of FIG. 6, when the lower surface 112*a* of the superjacent housing 110 is mated with the upper surface 134*a* of the subjacent housing 130, the upward facing flange 138 on the subjacent housing 130 is received into the groove 117 formed by the two downward facing, spaced-apart flanges 116*a*, 116*b* that extend from the lower surface 112*a* of the body 112. Referring to FIG. 12, which is a section view taken along lines 12-12 of FIG. 6, along another portion of the superjacent housing 110 the single downward facing flanges 118*a*, 118*b* extend from the lower surface of the body 112 into the groove 117 formed by the two upward facing, spaced-apart flanges 142*a*, 142*b* that extend from the upper surface 134*a* of the body 134.

The mating of flanges 116*a*, 116*b* with flange 138 and flanges 118*a*, 118*b* with flanges 142*a*, 142*b* are dimensioned and contoured to seal the superjacent housing 110 and the subjacent housing 130 to each other. It is contemplated that instead of a single flange on one housing 110, 130 engaging two spaced-apart flanges on the adjacent housing 110, 130 that both housings 110, 130 may include two spaced-apart mating flanges (not shown) such that when the superjacent housing 110 and the subjacent housing 130 are mated together a more tortuous or serpentine-like path is created between the parts.

The tortuous or serpentine-like path forms a labyrinth seal that is configured to prevent foam penetration or leakage during manufacturing. The labyrinth seal formed by the foregoing flanges are configured to hinder foam from passing between the superjacent housing 110 and the subjacent housing 130. In particular, the path formed between the superjacent housing 110 and the subjacent housing 130 is a tortuous or serpentine-like path that is difficult to be migrated by the foam during the aforementioned foaming process. Furthermore, by making the chute 120 integral with the body 112 of the superjacent housing 110, the risk that foam will pass between the chute 120 and the superjacent housing 110 is greatly reduced, if not eliminated.

As noted above, the subjacent housing 130 includes a plurality of tabs 146. The tabs 146 are dimensioned and positioned to align with the notches 119 formed in the superjacent housing 110. When the superjacent housing 110 and the subjacent housing 130 are mated together, the tabs 146 are received into the notches 119 in a snap-fit manner (see, FIG. 11). It is contemplated that the tabs 146 are cam or wedged-shaped to have a one-way assembly of the snap-fit feature. In this respect, the tabs 146 ensure a positive locking connection between the superjacent housing 110 and the subjacent housing 130 to maintain the seal therebetween. In this respect, the tabs 146 and the notches 119 help to secure the superjacent housing 110 to the subjacent housing 130. It is contemplated that other fastening elements and/or techniques, such as, but not limited to, screws, interference fit, welding, etc. may also be used to secure the superjacent housing 110 to the subjacent housing 130. In the embodiment shown, there is one locking tab 146 at a rear of the subjacent housing 130, two tabs 146 to the right of the opening 132 and two tabs 146 to the left of the opening 132 to maintain a positive locking between the superjacent housing 110 and the subjacent housing 130 about the perimeter of the housings 110, 130. It is also contemplated that the location of the notches 119 and tabs 146 could be reversed such that the tabs 146 are in the superjacent housing 110 and the notches 119 are in the subjacent housing 130. It is also contemplated that some of the tabs 146 may be in the superjacent housing 110 while others may be in the superjacent housing 110 and similarly for the notches 119.

Figure 13:
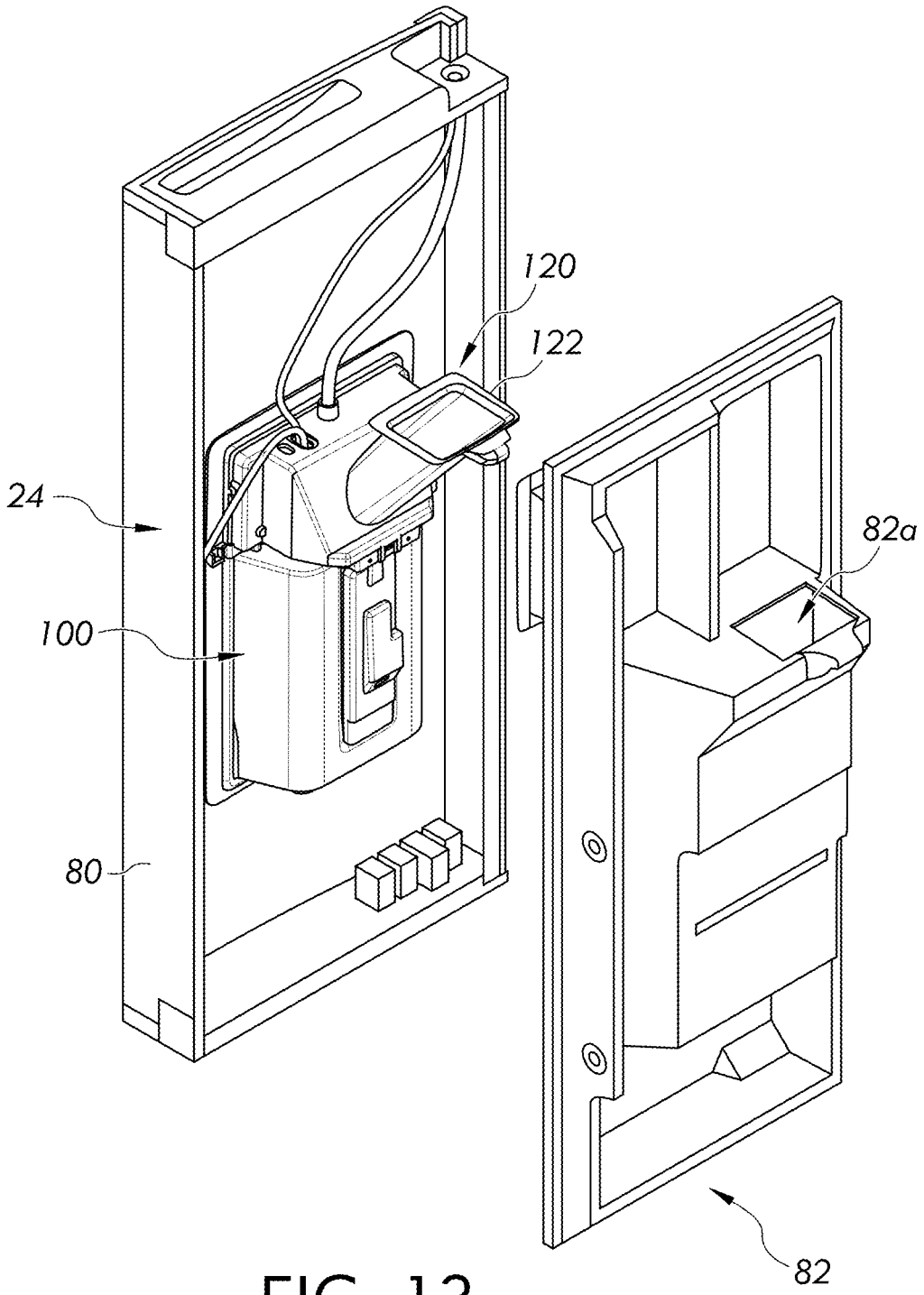
FIG. 13 is an exploded view of the housing assembly of FIG. 5 attached to a door assembly of the refrigerator of FIG. 1.

Referring to FIG. 13, after the superjacent housing 110 and the subjacent housing 130 are secured to each other as a sub-assembly, the combined housing 100 may be attached to a front panel or outer shell 80 of the refrigerator door 24. Thereafter, an inner liner 82 (e.g., a plastic liner) may be attached to the front panel 80 to enclose the dispensing assembly 50 between the front panel 80 and the liner 82. In particular, the dispensing assembly 50 is positioned to close a front opening 80*a* (FIG. 3) of the front panel 80. At the same time, the open distal end 122 of the chute 120 of the housing 110 may sealingly engage a mating opening 82*a* in the liner 82. It is contemplated that a gasket (not shown) may be positioned between the open distal end 122 of the chute 120 and the opening 82*a* of the liner 82. Once the liner 82 and the front panel 80 are secured together, an expanding foam or other insulating material (not shown) may be introduced into and substantially completely fill the closed space formed between the front panel 80 and the liner 82. In this respect, a sealed passageway is defined to extend through the finished refrigerator door from the opening 82*a* of the liner 82, through the ice chute 120, through the superjacent housing 110, through the subjacent housing 130 and to the opening 80*a* (FIG. 3) of the front panel 80.

In addition or alternatively, the ice maker used together with the present application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via a duct extending back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker used together with the instant application could be used in a fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via a ducting extending back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can be similarly used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

In another embodiment, there is provided an ice chute for a refrigerator, and more particularly, an ice chute having a discharge hole including a circular geometry.

It is known for refrigerators to include ice/water dispensers positioned on an external surface of a door. An ice maker positioned within the refrigerator is connected to the dispenser via an ice chute. Upon user actuation, ice will fall into an entrance hole of the ice chute and exit the dispenser via a discharge hole. The ice chute can be conically shaped such that a diameter of the entrance hole is greater than that of the discharge hole.

Figure 14:
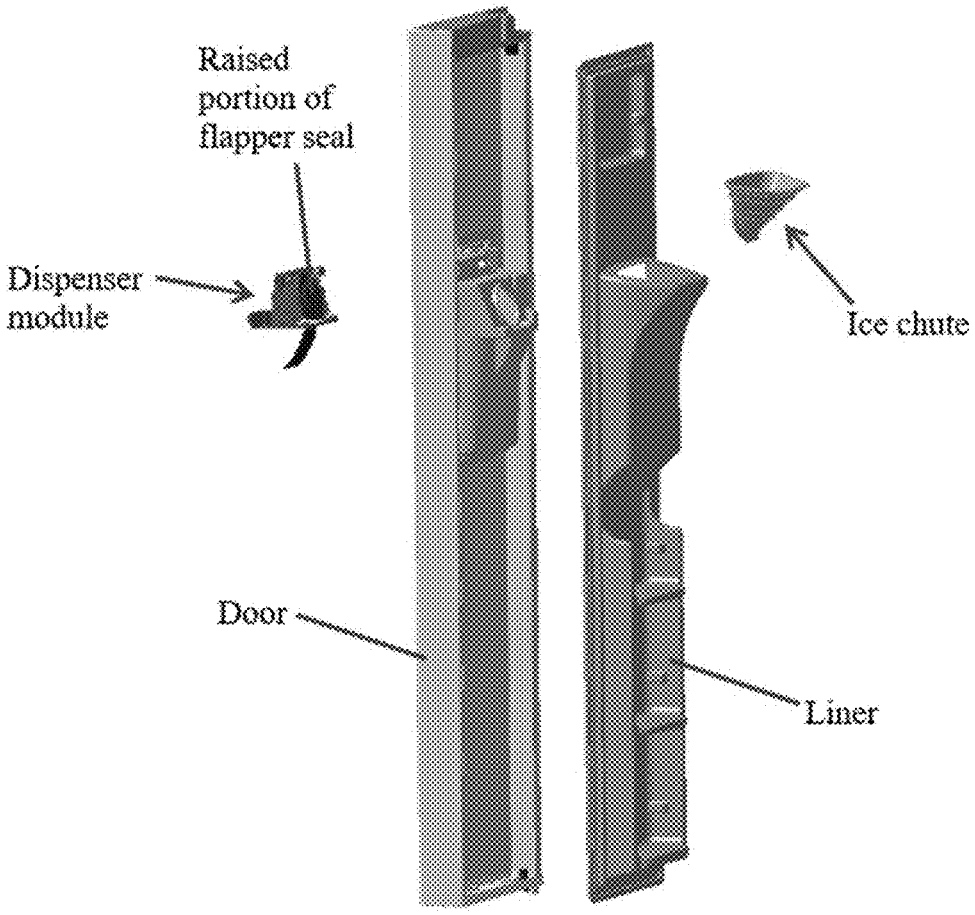
FIG. 14 is a rear exploded view of a refrigerator door, according to another embodiment.

As shown in FIG. 14, the dispenser module associated with the ice chute of the present embodiment includes a flapper seal that has a raised portion. In an installed position, this raised portion protrudes into the ice chute. Specifically, the raised portion enters the ice chute via the discharge hole.

Figure 15:
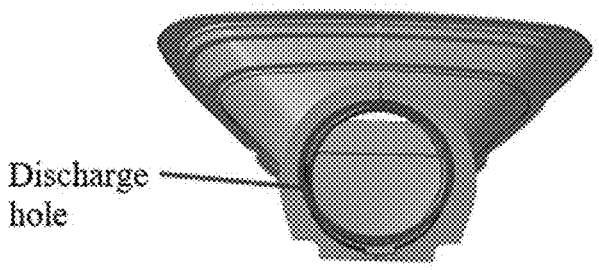
FIG. 15 is a front view of an ice chute of the refrigerator door of FIG. 14.

In order to provide a proper fit (and seal) with the flapper seal, the discharge hole (FIG. 15) of the ice chute is substantially circular in geometry. This geometric configuration substantially reduces (eliminates) air loss from the freezer, thus increasing overall energy efficiency of the appliance.

Figure 16:
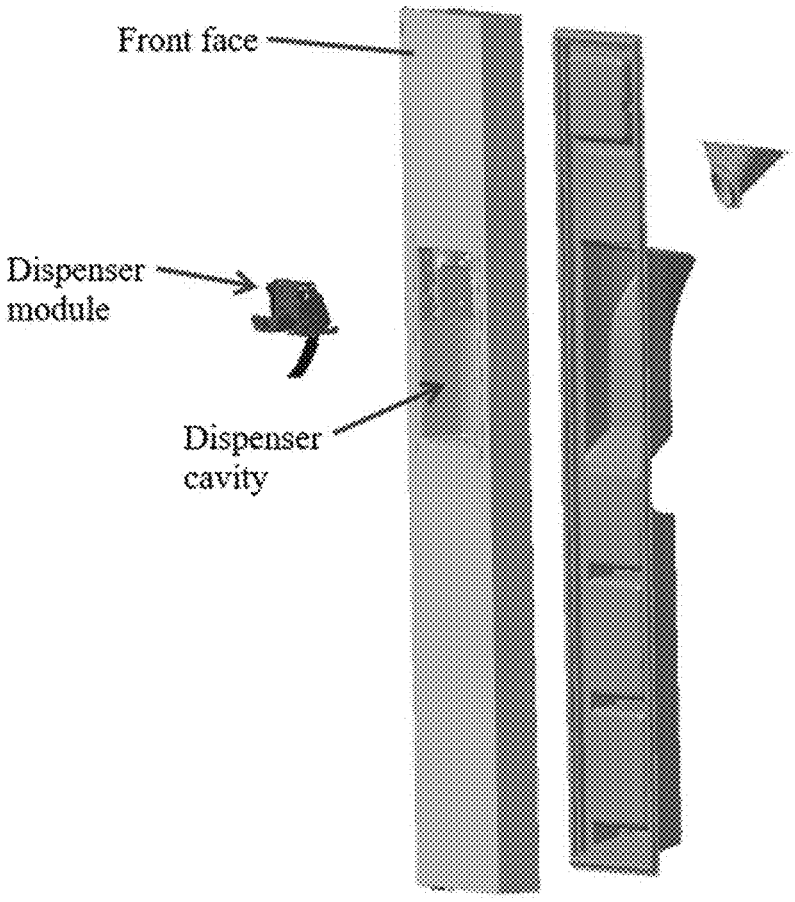
FIG. 16 is a front exploded view of the refrigerator door of FIG. 14.

As further shown in FIG. 16, the dispenser module is disposed within a dispenser cavity. Specifically, the dispenser cavity is secured to a rear surface of a front face of the door.

Figure 17:
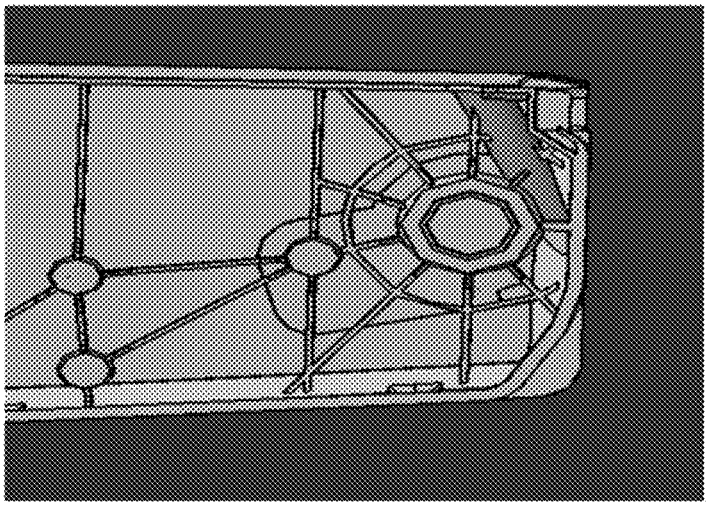
FIG. 17 is top view of a refrigerator door cap, according to yet another embodiment.

In another embodiment, there is a new refrigerator door cap. The door cap has an integrated manifold used to direct a hot melt adhesive (a sealant material) into specific locations prior to the foaming process in order to secure and seal the plastic door cap to the metal door skin. The hot melt sealant is applied after the plastic door cap is installed in the metal door skin. This hot melt prevents foam from leaking during the foaming process. The manifold (FIG. 17) is used to direct hot melt into the corners of the door assembly.

Figure 18:
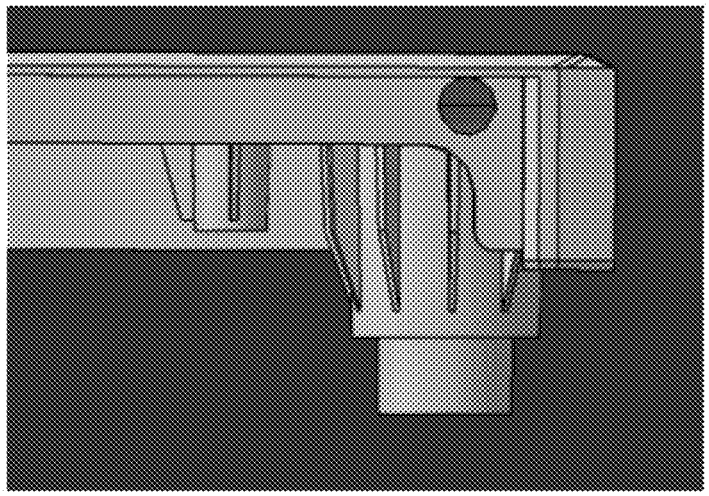
FIG. 18 is a front view of the refrigerator door cap of FIG. 17.

As seen in FIG. 18, the integrated manifold includes an opening hole on the side of the plastic door cap for applying the hot melt adhesive.

The hot melt travels through the top of the manifold and exits along the channel on the inside of the door cap. The hot melt then travels along the edge of the door cap to seal the corners.

Figure 19:
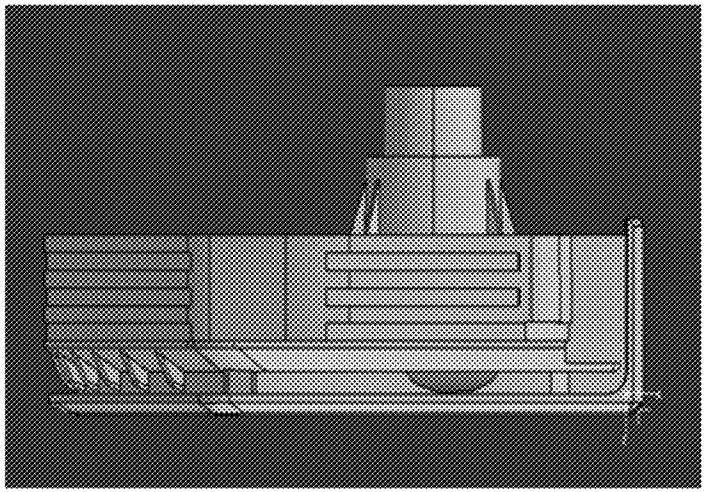
FIG. 19 is a side view of the refrigerator door cap of FIG. 17.

As illustrated in FIG. 19, the refrigerator door end caps include channels on the sides of the plastic door cap to specifically direct the adhesive to the interface between the plastic door cap and the metal door skin.

In yet another embodiment, there is provided a refrigerator appliance having a hot melt adhesive that is applied at strategic locations to improve sealing and structural rigidity of the refrigerator. This hot melt adhesive is soft when melted but hard when cooled, and is distinct from a soft melt adhesive, which has been used in the past for sealing refrigerators and remains soft when cooled.

Figure 20:
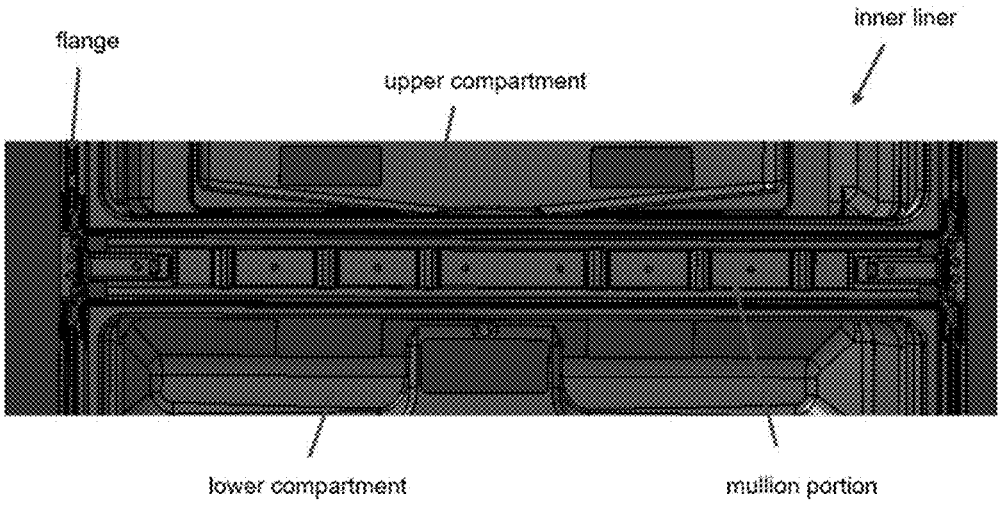
FIG. 20 is a partial front view of a mullion portion of a liner, according to still another embodiment.
Figure 21:
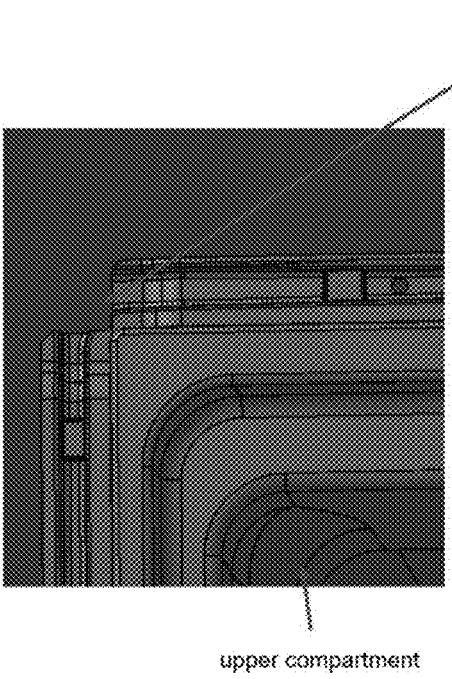
FIG. 21 is a partial front view of a corner of an upper compartment of the liner of FIG. 20, illustrating cutouts in the liner.
Figure 22:
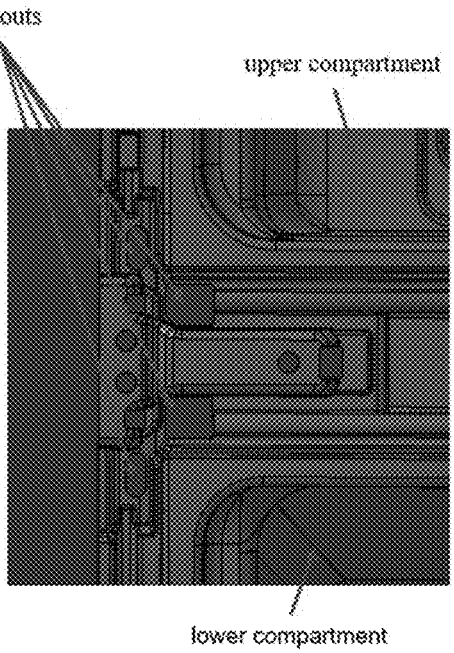
FIG. 22 is a partial front view of the mullion portion of the liner of FIG. 20, illustrating cutouts in the mullion portion.

More specifically, as shown in FIGS. 20-22, the refrigerator includes an inner liner that defines an upper compartment and a lower compartment. The inner liner includes a mullion portion between the two compartments, and a front flange that circumscribes the upper and lower compartments. During assembly of the refrigerator, the inner liner will be placed within an outer shell of the refrigerator that surrounds the sides and top of the inner liner, and foam insulation will be injected into the spaces between the inner liner and outer shell. Additionally, one or more front panels will be mounted along the front flange and mullion portion of the inner liner to conceal these portions of the inner liner.

Various cutouts are formed at the corners of the inner liner's flange and near the ends of the inner liner's mullion portion. These cutouts will permit the hot melt adhesive to be injected (in its melted state) with pressure from a rear side of the flange through the cutouts, thereby permeating into the corresponding spaces located in front of the cutouts. The adhesive once cooled will harden and glue the inner flange to the outer shell and front panels at these locations, thereby adding structural rigidity to the refrigerator. Moreover, the adhesive will provide a seal that obstructs air from entering the refrigerator at these joints of the inner liner, outer shell, and front panels.

Figure 23:
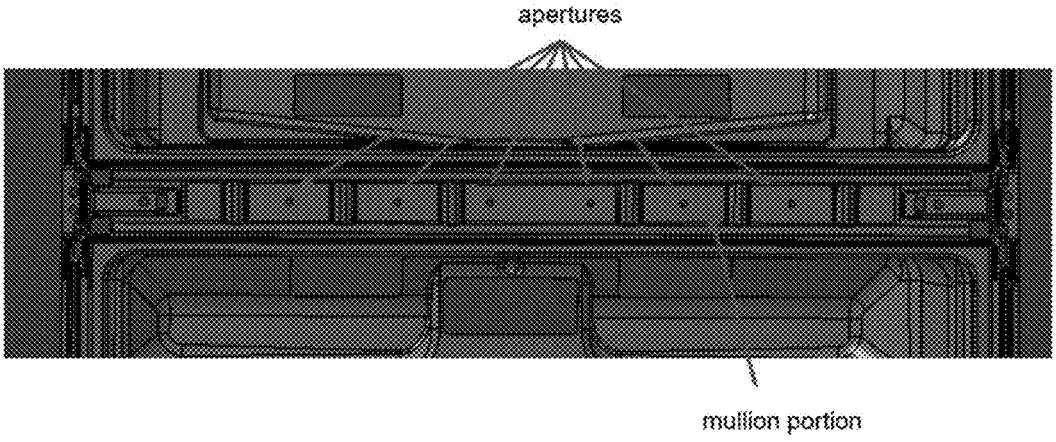
FIG. 23 is a partial front view of the mullion portion of the liner of FIG. 20, illustrating apertures in the mullion portion.

Another feature of the present design (FIG. 23) is that apertures are provided along the mullion portion, which will permit the foam insulation being injected behind the inner liner to enter the area in front of the mullion portion. This will help reduce sweating on the panels mounted in front of the mullion portion.

Figure 24:
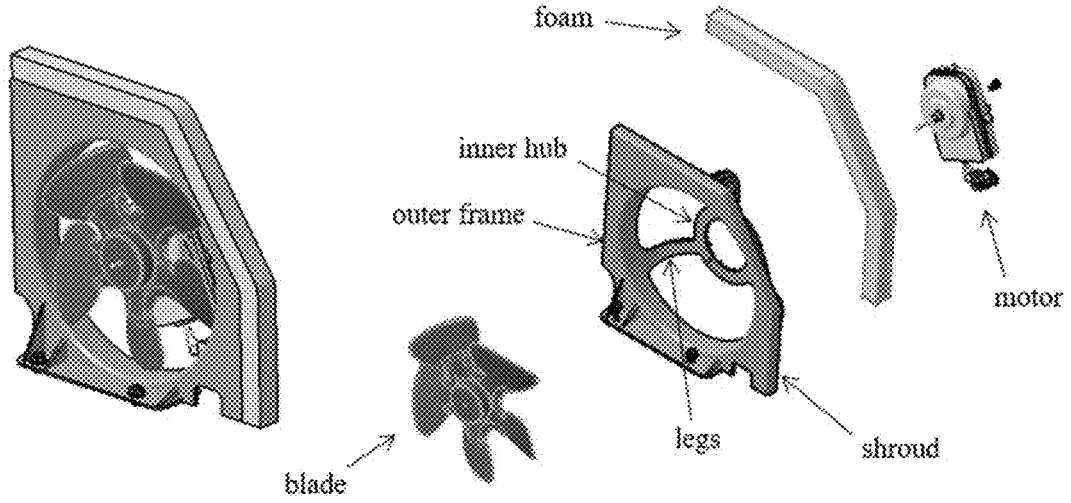
FIG. 24 (PRIOR ART)
FIG. 24 is an exploded view of a conventional shroud for a condenser fan of a refrigerator.
Figure 25:
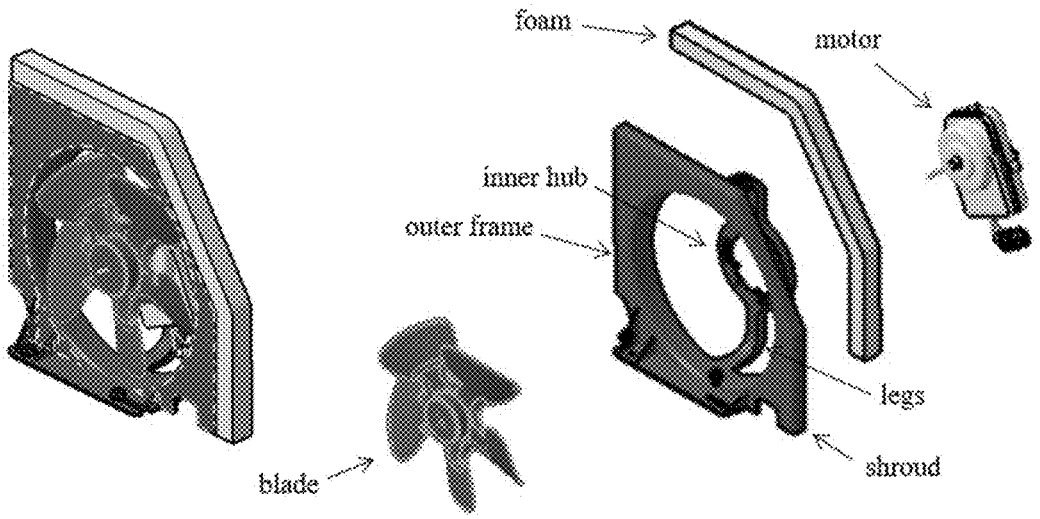
FIG. 25 is an exploded view of a shroud for a condenser fan of a refrigerator accordingly to another embodiment.

In still another embodiment, there is provided a shroud for a condenser fan of a refrigerator. FIG. 24 shows a previous shroud design, while FIG. 25 shows the present embodiment.

In the previous design, the shroud included an outer frame, an inner hub, and three legs connecting the inner hub to the outer frame. In the present embodiment, the shroud will have only two legs connecting its inner hub and outer frame. This reduction in legs will reduce noise, improve energy efficiency, and allow for easier service and installation. In yet another embodiment, there is provided a baffle for a freezer air tower, specifically for use in a top-mount refrigerator (i.e., freezer on top, fresh food on bottom).

Figure 27:
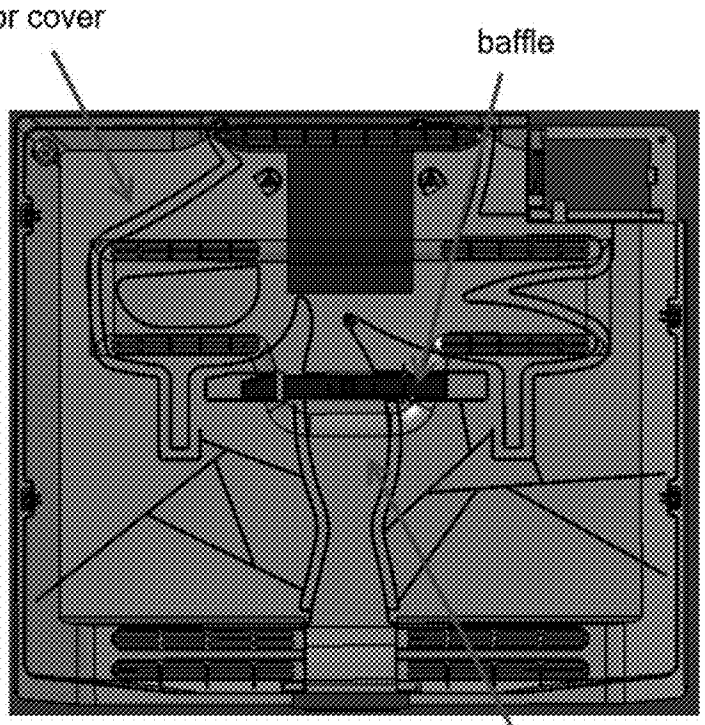
FIG. 27 is a rear view of the evaporator cover of FIG. 26.
Figure 26:
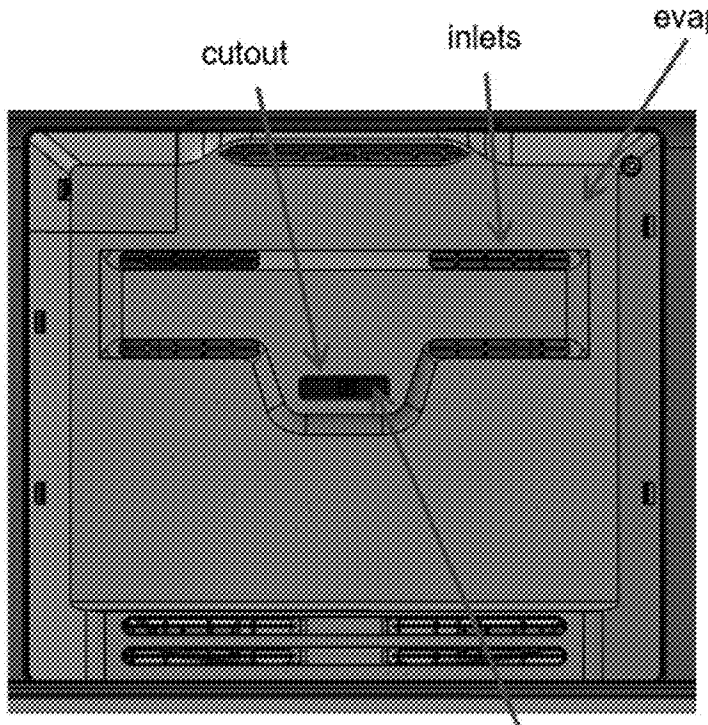
FIG. 26 is a front view of an evaporator cover, according to another embodiment.

Referring to FIGS. 26 and 27, the freezer air tower includes an evaporator cover that defines a plurality of air inlets for receiving air from the freezer compartment. The evaporator cover further defines an air channel on a rear side of the evaporator cover for delivering air from the inlets to a refrigerator compartment below.

Figure 28:
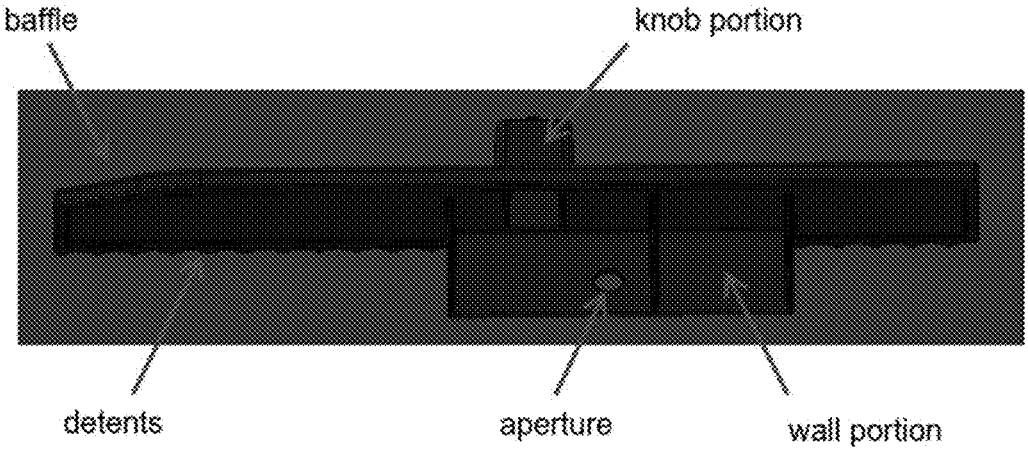
FIG. 28 is an enlarged rear view of a baffle of the evaporator cover of FIG. 26.

The baffle (FIG. 28) is slidably mounted on the rear side of the evaporator cover by sliding the baffle under a strap such that the baffle can be slid horizontally. The baffle includes a knob portion that extends through a cutout in the evaporator cover and can be manipulated by a user to adjust the horizontal position of the baffle. Moreover, the baffle includes a wall portion that can regulate airflow into the air channel of the evaporator cover based on the horizontal position of the baffle.

By sliding the baffle left or right, a user can adjust how much of the airflow path in the air channel is blocked by the wall portion of the baffle. When the baffle is slid all the way in one direction (e.g., left), the wall portion can provide little or no obstruction to the airflow path. Meanwhile, when the baffle is slid all the way in the opposite direction (e.g., right), the wall portion can block almost the entire airflow path. An aperture is provided in the wall portion such that a minimum amount of airflow can still pass through the wall portion into the air channel.

The baffle also includes detents on the bottom of baffle that will interact with a feature on the evaporator cover to give the customer a tactile feeling of adjustment when moving the baffle.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A dispenser assembly for a refrigerator door, the dispenser assembly comprising:

a superjacent housing having an open front and an ice chute extending from a rear of the superjacent housing, the ice chute having a proximal end integrally attached to the rear of the superjacent housing and an open distal end; and a subjacent housing having an upper end attachable to a lower end of the superjacent housing, the subjacent housing having an open front defining a cavity for receiving a container, wherein one of the lower end of the superjacent housing and the upper end of the subjacent housing includes spaced-apart flanges defining a groove therebetween, said groove configured to receive a mating flange in the other of the lower end of the superjacent housing and the upper end of the subjacent housing to define a labyrinth seal between the superjacent housing and the subjacent housing.

2. The dispenser assembly of claim 1, wherein the superjacent housing includes an opening in the lower end of the superjacent housing that communicates with an opening in the upper end of the subjacent housing when the superjacent housing engages the subjacent housing.

3. The dispenser assembly of claim 1, wherein the open distal end of the ice chute is configured to sealingly engage an inner liner of the refrigerator door.

4. The dispenser assembly of claim 1, wherein the ice chute is integrally formed to the rear of the superjacent housing.

5. The dispenser assembly of claim 1, wherein the superjacent housing and subjacent housing are secured to each other.

6. The dispenser assembly of claim 5, wherein one of the lower end of the superjacent housing and the upper end of the subjacent housing includes a receiving element to receive a corresponding engagement element in the other of the lower end of the superjacent housing and the upper end of subjacent housing.

7. The dispenser assembly of claim 6, wherein the receiving element is a notch and the corresponding engagement element is a tab that engages the notch in a snap-fit manner.

8. The dispenser assembly of claim 1, wherein the superjacent housing and the subjacent housing are made of a plastic material.

9. A refrigerator door comprising:

an outer shell having an opening formed therein;

an inner liner attached to a rear of the outer shell to define a sealed cavity configured to be filled with an insulating material, the inner liner including an opening; and a dispenser assembly disposed in the sealed cavity formed between the outer shell and the inner liner, the dispenser assembly comprising:

a superjacent housing attached to the outer shell and including an open front communicating with the opening of the outer shell and an ice chute extending from a rear of the superjacent housing, the ice chute having a proximal end integrally attached to the rear of the superjacent housing and an open distal end sealingly attached to the inner liner and communicating with the opening of the inner liner; and a subjacent housing attached to a lower end of the superjacent housing, the subjacent housing having an open front communicating with the opening of the outer shell and defining a cavity for receiving a container, wherein one of the lower end of the superjacent housing and an upper end of the subjacent housing includes spaced-apart flanges defining a groove therebetween, said groove configured to receive a mating flange in the other of the lower end of the superjacent housing and the upper end of the subjacent housing to define a labyrinth seal between the superjacent housing and the subjacent housing and the superjacent housing and the subjacent housing sealingly engage the outer shell around the opening of the outer shell.

10. The refrigerator door of claim 9, wherein the superjacent housing includes an opening in the lower end that communicates with an opening in the upper end of the subjacent housing when the superjacent housing engages the subjacent housing.

11. The refrigerator door of claim 9, wherein a sealed passageway is defined from the opening of the inner liner, through the ice chute, through the superjacent housing, through the subjacent housing and to the opening of the outer shell.

12. The refrigerator door of claim 9, wherein the ice chute is integrally formed to the rear of the superjacent housing.

13. The refrigerator door of claim 9, wherein the superjacent housing and subjacent housing are secured to each other.

14. The refrigerator door of claim 13, wherein one of the lower end of the superjacent housing and the upper end of the subjacent housing includes a receiving element to receive a corresponding engagement element in the other of the lower end of the superjacent housing and the upper end of subjacent housing.

15. The refrigerator door of claim 14, wherein the receiving element is a notch and the corresponding engagement element is a tab that engages the notch in a snap-fit manner.

16. The refrigerator door of claim 9, wherein the superjacent housing and the subjacent housing are made of a plastic material.

* * * * *